US006137510A

United States Patent [19]

Sato et al.

[11] Patent Number: 6,137,510

[45] Date of Patent: Oct. 24, 2000

[54] INK JET HEAD

[75] Inventors: Tamaki Sato, Kawasaki; Yasuyuki Tamura, Yokohama; Mineo Kaneko, Tokyo; Masayoshi Tachihara, Chofu; Yasutomo Watanabe, Hiratsuka; Shuichi Murakami, Kawasaki; Michinari Mizutani; Takashi Inoue, both of Tokyo, all of Japan

[73] Assignee: Canon Kabushiki Kaisha, Tokyo, Japan

[21] Appl. No.: 08/969,837

[22] Filed: Nov. 13, 1997

[30] Foreign Application Priority Data

Nov. 15, 1996 [JP] Japan ..... 8-304719
Nov. 16, 1996 [JP] Japan ..... 8-320733

[51] Int. Cl.[7] ..... B41J 2/05

[52] U.S. Cl. ..... 347/63; 347/65

[58] Field of Search ..... 347/63, 65, 92, 347/93, 94

[56] References Cited

U.S. PATENT DOCUMENTS

| | | | |
|---|---|---|---|
| 4,229,265 | 10/1980 | Kenworthy | 204/11 |
| 5,153,613 | 10/1992 | Yamaguchi et al. | 346/140 |
| 5,159,354 | 10/1992 | Hirasawa et al. | 346/140 R |
| 5,164,747 | 11/1992 | Osada et al. | 346/140 R |
| 5,227,812 | 7/1993 | Watanabe et al. | 346/140 R |
| 5,322,594 | 6/1994 | Bol | 156/634 |
| 5,343,227 | 8/1994 | Hirosawa et al. | 349/42 |
| 5,463,413 | 10/1995 | Ho et al. | 347/65 |
| 5,478,606 | 12/1995 | Ohkuma et al. | 427/555 |
| 5,574,488 | 11/1996 | Tamura | 347/63 |
| 5,576,748 | 11/1996 | Tamura | 347/58 |
| 5,682,190 | 10/1997 | Hirosawa et al. | 347/94 |
| 5,696,543 | 12/1997 | Koizumi et al. | 347/17 |

FOREIGN PATENT DOCUMENTS

| | | |
|---|---|---|
| 0 244 937 | 6/1987 | European Pat. Off. . |
| 0 627 318 | 12/1994 | European Pat. Off. . |
| 39 17 434 | 11/1989 | Germany . |
| 63-23491 | 10/1987 | Japan . |
| 4-10940 | 1/1992 | Japan . |
| 4-10941 | 1/1992 | Japan . |
| 4-10942 | 1/1992 | Japan . |

*Primary Examiner*—Arthur T. Grimley
*Assistant Examiner*—Greg Moldafsky
*Attorney, Agent, or Firm*—Fitzpatrick, Cella, Harper & Scinto

[57] ABSTRACT

There is disclosed an ink jet head comprising plural discharge energy generating elements for generating energy to be used for discharging ink droplets, ink discharge openings for discharging the ink droplets, a substrate bearing thereon an array of the plural discharge energy generating elements and an ink supply aperture consisting of a penetrating hole extending along the direction of array of the discharge energy generating elements, and an orifice plate provided with the ink discharge openings, in which the substrate and the orifice plate are mutually adjoined to define therebetween ink paths connecting the ink discharge openings and the ink supply aperture, wherein the orifice plate comprises plural projections in a position corresponding to the ink supply aperture.

16 Claims, 16 Drawing Sheets

INK JET HEAD

BACKGROUND OF THE INVENTION

1. Field of the Invention

The present invention relates to an ink jet head which emits ink liquid droplet from a discharge opening of an orifice plate, perpendicularly to the surface of a substrate bearing a head generating resistance thereon, and a producing method therefor.

2. Related Background Art

The ink jet recording systems have become rapidly popular in recent years, because of its advantages that the noise generation at the recording operation is negligibly small, that the high-speed recording is possible and that the recording can be made on socalled plain paper without any particular processing.

Among the ink jet recording heads, the one that discharges the ink droplet perpendicularly to the substrate bearing the element for generating the ink discharging energy is called the recording head of side shooter type, and the present invention relates to the configuration of such side-shooter type head.

In the field of such side-shooter type recording head, the Japanese Patent Laid-Open Application Nos. 4-10940, 4-10941 and 4-10942 disclose a configuration in which a bubble generated by the heat from a heat generating resistor communicates with the external air to discharge the ink droplet (cf. FIGS. 3A to 3C).

Such configuration of the ink jet head allows a reduction in the distance between the ink discharge energy generating element and the orifice, in contrast to the conventional producing method for the side-shooter type ink jet head (for example as disclosed in the Japanese Patent Laid-Open Application No. 62-234941), and also to easily achieve recording with smaller ink droplets, thereby responding to the recent requirement for high-precision recording.

However, in the ink jet recording head produced according to the method described in the above-mentioned patent applications, as shown in FIGS. 3A to 3C, the thickness of the orifice plate remains substantially constant from above the ink supply aperture to the area of the bubble generating chamber and is very small because of the short distance from the ink discharge energy generating element to the orifice surface.

Such thin wall member, extended over a wide area and present in a suspended state, is extremely disadvantageous in terms of the strength of the recording head.

For example, such orifice plate may be broken by the paper jammed in the course of the recording operation, and may also become unreliable for the wiping operation with the wiping blade for the recovery of the ink discharge failure.

Also in case the orifice plate itself is composed of a resinous material, it may be swelled by the ink liquid, thus detrimentally affecting the ink discharge characteristics.

The thickness of the orifice plate may be increased for the purpose of increasing the strength thereof, but such increased thickness prolong the distance between the ink discharge energy generating element and the orifice surface, whereby it becomes extremely difficult to stably achieve the recording with smaller ink droplet, which is a strong means for high-precision recording.

Also in the configuration disclosed in the above-mentioned patent applications, it is found that the influence on the ink discharge characteristics and the recorded image, by the retentive bubbles resulting from the air dissolved in the ink becomes more conspicuous because of the smaller height of the ink flow path. In the following, such influence on the ink discharge characteristics and the recorded image, by the retentive bubbles resulting from the air dissolved in the ink, will be explained in more details. Usually, air is dissolved in the saturated state in the ink contained in the ink jet recording head. When the electrothermal converting element is activated in this state, in the course of repetition of the bubble generation by the phase change of the ink and the rapid diabetic contraction of the bubble, the air which has been dissolved in the ink may suddenly appear as a bubble of 1 $\mu$m or smaller in diameter in the ink. Such bubble is known to dissolve again into the ink after a time determined by the bubble diameter, the surface tension of the ink, the saturated vapor pressure of the air etc. For example, a bubble of 1 $\mu$s or less in diameter re-dissolves in the ink within a time of 1 $\mu$s or less. However, in case plural electrothermal converting elements are activated in succession at a high frequency, such bubbles appear in plurality in the ink and mutually merge and grow before re-dissolution. It is also known that the time required for re-dissolution becomes significantly longer with the increase of the diameter of the bubble. As a result, plural retentive bubbles in the size of several tens to several hundreds microns are eventually stored in the ink jet recording head. Such retentive bubbles are scarcely re-dissolved in the ink and detrimentally affect the ink droplet discharge characteristics. More specifically, if such retentive bubble blocks the ink flow path, the nozzle cannot be filled with the sufficient amount of ink and results in defective ink discharge. Also if a giant retentive bubble (in the order of several hundred microns) is generated in the ink jet recording head and comes eventually into communication with the external air, the air may enter the nozzle and disrupt the ink meniscus, whereby the ink in the ink jet recording head is sucked into the ink tank by the negative pressure thereof and all the nozzles may become incapable of ink discharge. The most effective method for avoiding such detrimental effect of the retentive bubbles is the suction (or pressurized) recovery process of discharging the ink, with such retentive bubbles therein, from the discharge openings by suction or by pressurizing, before such bubbles grow to a size causing the detrimental effects. However, such method not only significantly increases the consumption of the ink but also deteriorates the throughput if such operation is conducted in the course of the recording operation. Another method is to eliminate such dissolved air from the air by a suitable method (degassing) and to use such degassed ink in the ink jet recording head. However, such method is only applicable to a large-scale printing apparatus, since such method is effective only for about several ten minutes after degassing and the device required for ink degassing is relatively large.

SUMMARY OF THE INVENTION

In consideration of the foregoing, an object of the present invention is to provide an ink jet recording head with an increased mechanical strength of the orifice plate and with increased reliability.

Another object of the present invention is to provide an ink jet recording head capable of reducing the detrimental effects of the retentive bubbles in the head on the ink discharge characteristics, thereby achieving reliable ink droplet discharge.

Still another object of the present invention is to provide an ink jet recording device capable of controlling the retentive bubbles and reducing the frequency of recovery operations, thereby achieving an excellent throughput and reducing the ink consumption.

The above-mentioned objects can be attained, according to the present invention, by an ink jet recording head comprising:

a plurality of ink discharge energy generating elements for generating energy to be utilized for discharging ink droplets;

ink discharge openings for discharging the ink droplets;

a substrate provided thereon with an array of the plural ink discharge energy generating elements and an ink supply aperture consisting of a penetrating hole extended in the direction of the array of the ink discharge energy generating elements; and an orifice plate provided with the above-mentioned discharge openings, wherein the substrate and the orifice plate are mutually so adjoined as to form therebetween ink paths respectively connecting the ink discharge openings and the ink supply aperture.

The above-explained configuration of the present invention allows to provide a highly reliable ink jet head in which the orifice plate above the ink supply aperture is improved in the mechanical strength and the orifice plate is rendered resistant to the swelling by the ink.

Also the ink jet head of the above-explained configuration of the present invention allows to relax the detrimental effects, on the ink discharge characteristics, of the bubbles retained in the ink jet head. Also in the ink jet recording device equipped with the ink jet head of the configuration of the present invention, the ink discharge characteristics are scarcely affected even when the bubble grows to a size of several hundred microns, so that the means for discharging the ink together with the bubbles for example by suction can be made minimum, and there can be achieved a higher throughput and a lower ink consumption.

In the present text, the "rib structure" means, in the ink jet head which discharges the ink droplets perpendicularly to the surface of the substrate bearing the heat generating resistors, means a rib formed, at the upper surface (at the side of ink droplet discharge) of the ink supply aperture and at the lower surface (at the side of ink supply) of the orifice plate, integrally with the orifice plate and serving also as a lateral wall of the ink path, such rib preferably extending at least from the bubble generating chamber to the position on the ink supply aperture.

BRIEF DESCRIPTION OF THE DRAWINGS

FIG. 3A is a schematic view showing the basic configuration of a prior art, while

FIG. 4A is a schematic view showing the basic configuration of embodiment 1 of the present invention, while

FIG. 5A is a schematic view showing the basic configuration of embodiment 2 of the present invention, while

FIG. 6A is a schematic view showing the basic configuration of embodiment 3 of the present invention, while

FIG. 8A is a schematic view showing the basic configuration of embodiment 4 of the present invention, while

DESCRIPTION OF THE PREFERRED EMBODIMENTS

In the following the present invention will be clarified in detail with reference to the attached drawings.

Figure 1:
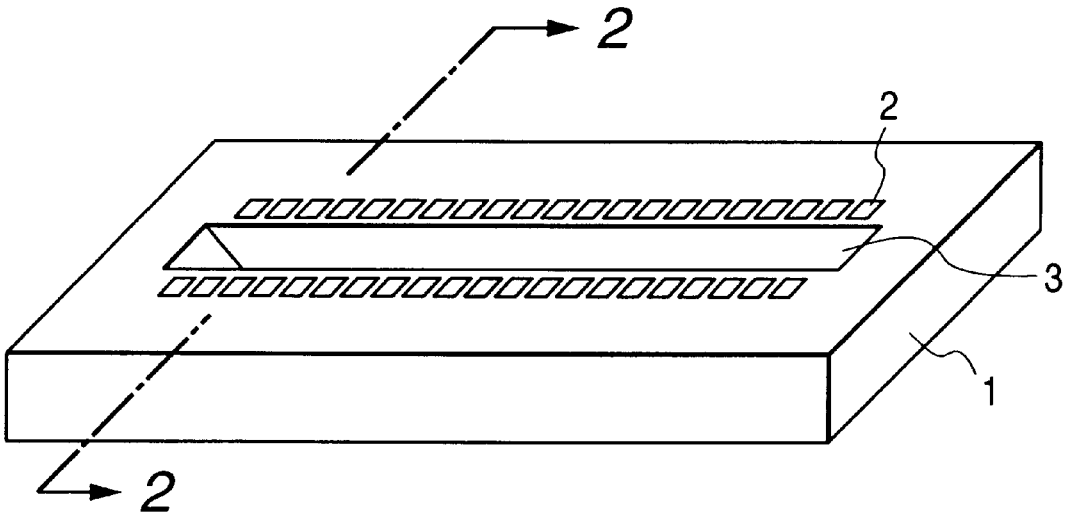
FIG. 1 is a schematic view showing the basic configuration of embodiments 1 to 3 of the present invention.

FIG. 1 is a schematic view showing the basic configuration of the present invention, and FIGS. 2A to 2G (cross-sectional views along a line 2—2 in FIG. 1) show a method of producing the ink jet head of the present invention. In the following, there will at first be briefly explained the method of producing the ink jet head of the present invention.

Figure 2A:
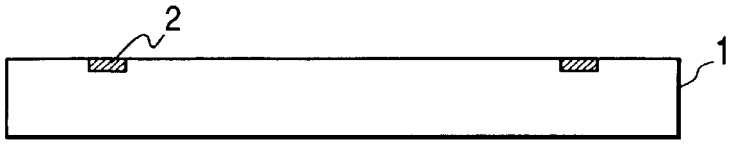
FIGS. 2A, 2B, 2C, 2D, 2E, 2F and 2G are views showing the basic configurations of embodiments 1 to 3 of the present invention.

At first, on a substrate 1 shown in FIG. 1, there are formed a desired number of ink discharge energy generating elements 2 such as electrothermal converting elements or piezoelectric elements (cf. FIG. 2A).

Figure 2B:
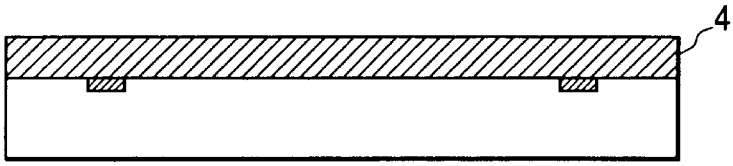
Figure 2C:
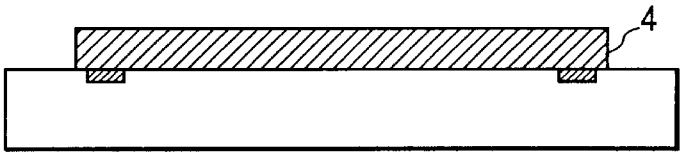

Then, as shown in FIG. 2B (cross-sectional view along the line 2—2 in FIG. 1), on the substrate 1 bearing the ink discharge energy generating elements 2, there is formed a soluble resin layer 4, and an ink path pattern is formed in the resin layer 4, as shown in FIG. 2C. In this operation, a pattern constituting a rib structure as shown in FIGS. 4A to 4C and 5A to 5C is formed on the upper surface of the resin layer 4, corresponding to a portion where an ink supply aperture 3 (cf. FIG. 2E) is formed.

Figure 2D:
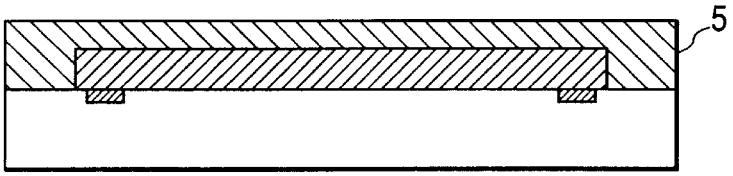
Figure 2E:
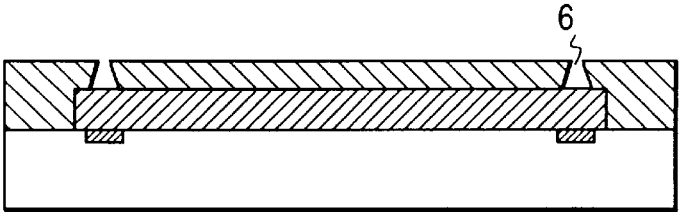
Figure 2F:
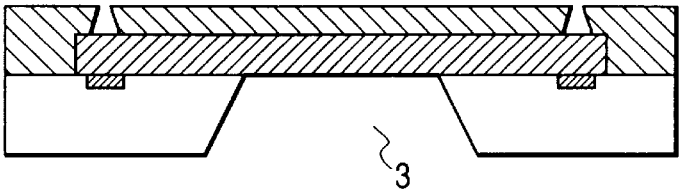

Then, on the above-mentioned soluble resin layer 4, there is formed a cover resin layer 5, as shown in FIG. 2D, and ink discharge openings 6 are formed in the cover resin layer 5 (FIG. 2E). Such ink discharge opening can be formed by a conventionally known method, such as etching with oxygen plasma, hole formation with an excimer laser, or exposure with ultraviolet or deep UV light.

Then an ink supply aperture 3 is formed in the substrate 1.

The ink supply aperture 3 is formed by chemical etching of the substrate. More specifically, the substrate 1 can be composed of an Si (silicon) substrate, which can be anisotropically etched with a strong alkaline solution for example of KOH, NaOH or TMAH (FIG. 2G).

The ink supply aperture may be formed prior to the formation of the patterns of the ink paths and the pattern constituting the rib structure (FIGS. 2B and 2C) and the formation of the ink discharge openings (FIGS. 2D and 2E). The rib structure of the present invention may be obtained, as explained in the foregoing, by forming a soluble resin layer on a flat surface, then patterning such resin layer and forming a cover resin layer thereon. The formation of the ink supply aperture after the formation of the ink path pattern, the rib-structure constituting pattern and the ink discharge openings may be achieved by a mechanical method such as drilling or by an optical energy such as of laser, but these methods are usually inadequate as they may cause damage to the already formed ink path pattern etc.

For this reason, the ink supply aperture is most preferably achieved by chemical etching, particularly anisotropic etching of Si substrate.

Figure 2G:
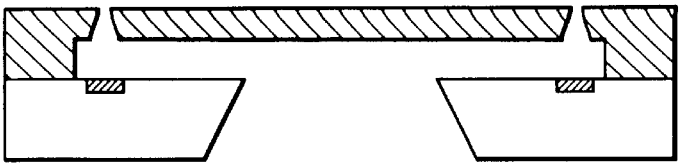

Then the soluble resin layer 4 is dissolved out to form ink paths and bubble generating chambers as shown in FIG. 2G. In this operation, the rib structure is formed above the ink supply aperture 3.

Finally, electric connections (not shown) for driving the heat generating resistors 2 are formed, whereby the ink jet recording head is completed.

The ink jet head of the present invention, having the rib structure in a portion at the side of the ink paths, corresponding to the ink supply aperture, in the cover resin layer constituting the orifice plate, can improve the mechanical strength thereof and also can suppress the growth of the retentive bubbles. In order to reduce the influence resulting from the swelling of the orifice plate, the rib preferably extends from the bubble generating chamber to the portion of the ink supply aperture.

In the following there will be detailedly explained, the effect of the above-explained configuration on the retentive bubbles, in comparison with the conventional configuration and with reference to the attached drawings.

Figure 12A:
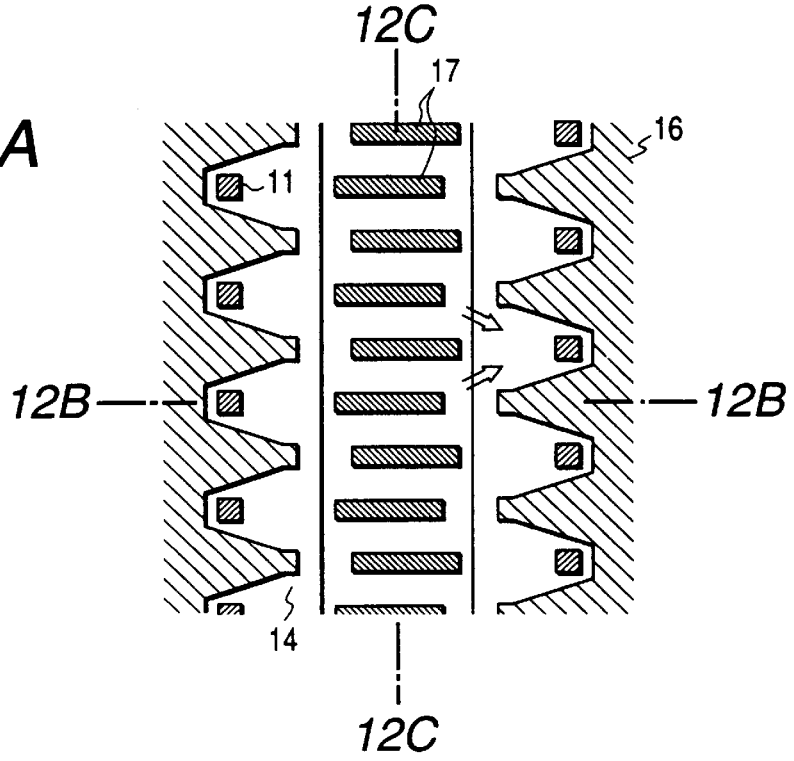
FIGS. 12A, 12B and 12C are schematic views showing an ink jet head of an embodiment 5.
Figure 12B:
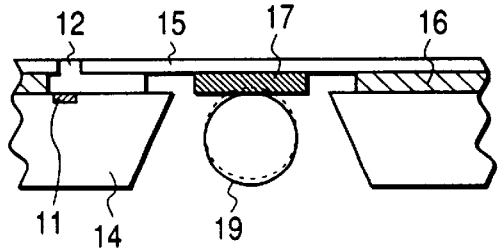
Figure 12C:
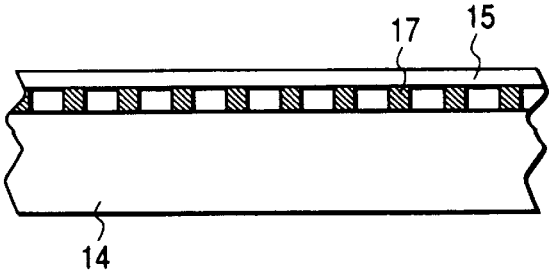
Figure 16A:
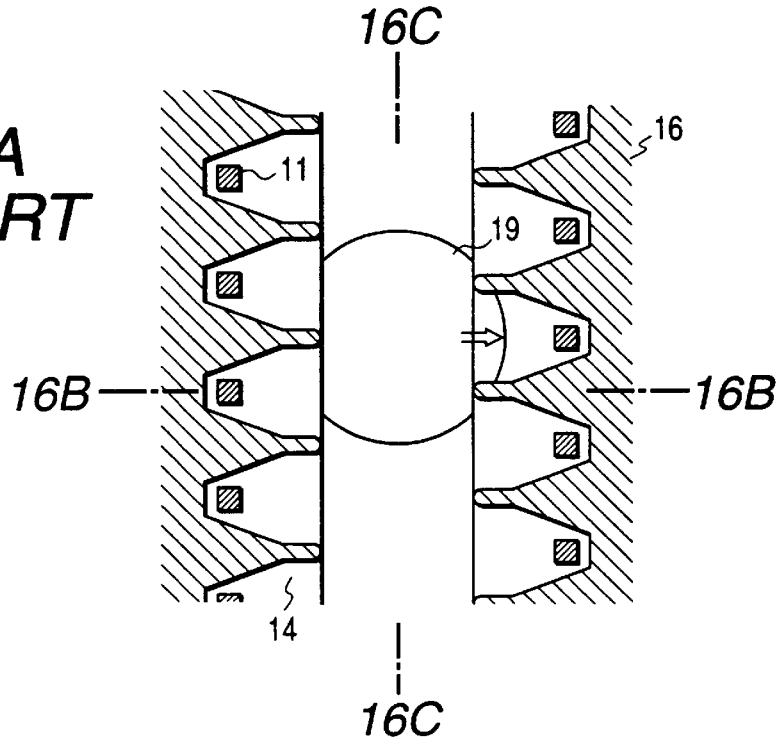
FIG. 16A PRIOR ART
FIGS. 16A, 16B and 16C are schematic views showing a conventional ink jet head.
Figure 16B:
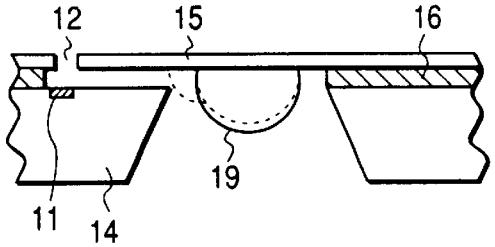
FIG. 16B PRIOR ART
Figure 16C:
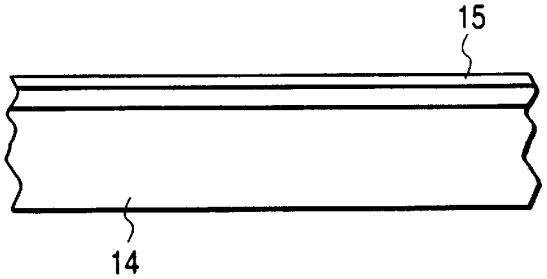
FIG. 16C PRIOR ART
Figure 17A:
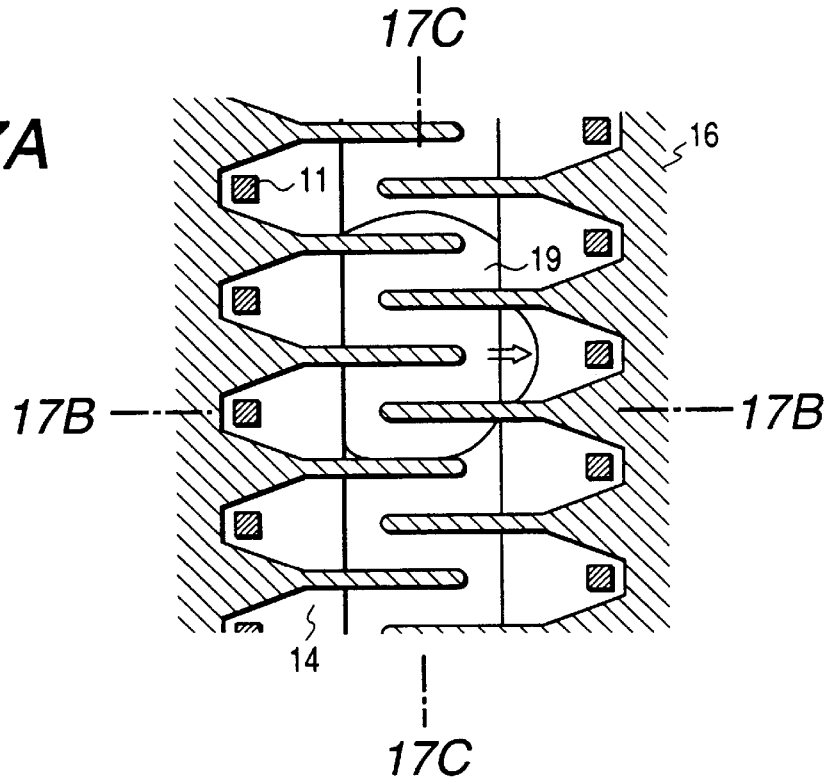
FIGS. 17A, 17B and 17C are schematic views of an ink jet head in which the nozzle wall is extended to a position directly above the supply aperture.
Figure 17B:
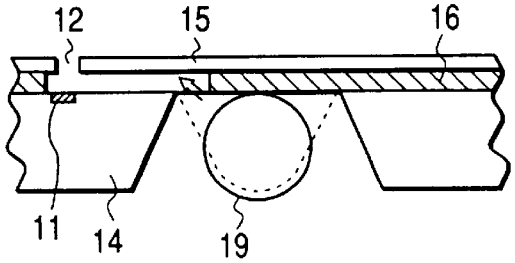
Figure 17C:
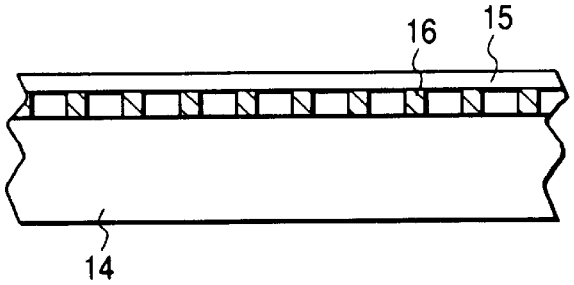

FIGS. 12A to 12C illustrate an ink jet head of the representative configuration of the present invention, while FIGS. 16A to 16C illustrate an ink jet head of the conventional configuration, and FIGS. 17A to 17C illustrate an ink jet head in which partition walls for forming the ink path for the individual electrothermal converting element extend to the ink supply aperture in order to enhance the effect of the present invention. These ink jet heads are provided with ink droplet discharge means featuring the ink jet recording method described in the Japanese Patent Laid-Open Application Nos. 4-10940 and 4-10941, and are namely featured by a fact that the bubble at the ink discharge operation communicates with the external air. FIGS. 12A to 12C are respectively a magnified plan view of the substrate bearing the electrothermal converting elements, and vertical cross-sectional views along lines 12B—12B and 12C—12C.

At first there will be explained the detrimental effect, on the ink discharge, of the bubble remaining without dissolution in the ink jet head. In the conventional ink jet head, it is already observed that the retentive bubble, sticking to the internal surface of the orifice plate about directly above the ink supply aperture, grows at a certain time as shown in FIGS. 16A to 16C. Such retentive bubble 19 is so shaped as to be locally drawn into the ink path, by the ink flow caused by the ink discharge in the ink jet head, or by the ink flow toward the ink discharge opening 12 for re-filling the ink path. In practice, if the retentive bubble 19 of a magnitude of about 150 $\mu$m remains in a position as shown in FIGS. 16A to 16C, it is drawn into the ink path to disconnect the ink therein, whereby the ink supply to the ink path becomes deficient. According to the observation of the present inventors, if the ink droplet discharge is continued in such state, such retentive bubble 19 gradually proceeds toward the ink discharge opening 12, and the interior of the ink jet head becomes empty at the moment when the retentive bubble 19 comes into communication with the external air.

Figure 11A:
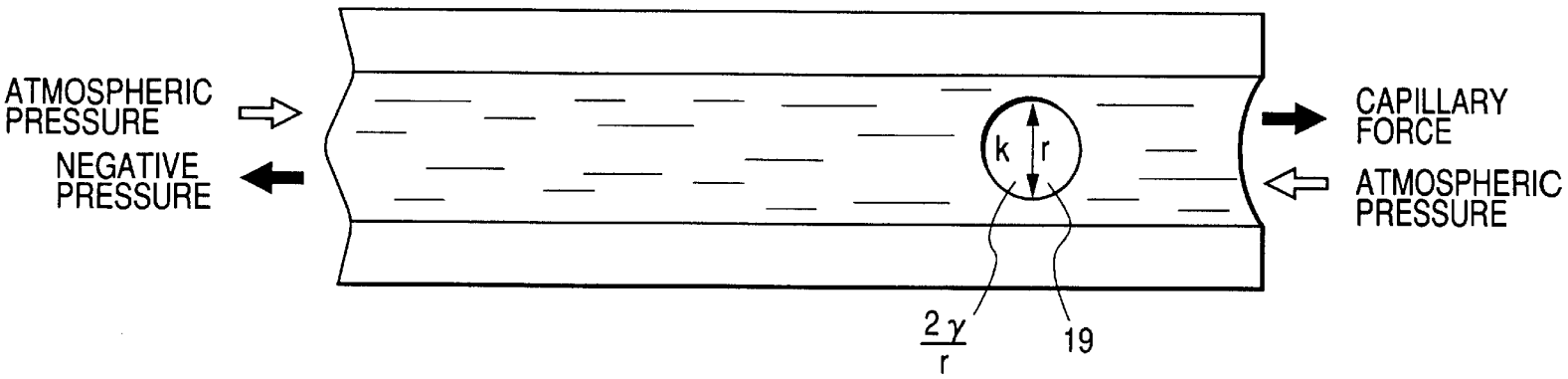
FIGS. 11A. 11B and 11C are schematic views showing the states of a retentive bubble in the ink jet head.
Figure 11B:
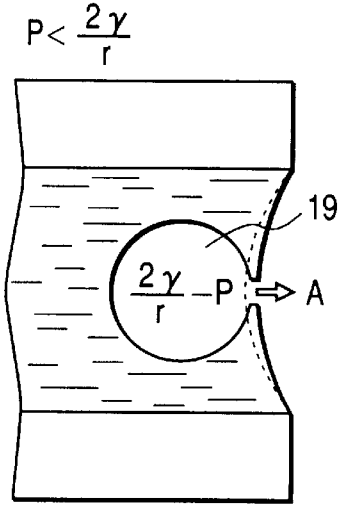
Figure 11C:
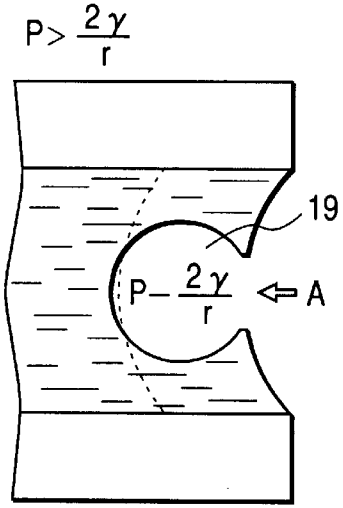

Such phenomenon will be explained further with a simplified model shown in FIGS. 11A to 11C. It is assumed that a fine tube is filled with ink, and an end A of the tube is maintained at the atmospheric pressure while the other end is maintained at atmospheric pressure −P (kPa). It is also assumed that the ink can freely enter and flow out from the tube. The pressure P means, in practice, the negative pressure by which the ink tank of the ink jet head sucks the ink. At the end A, the atmospheric pressure is balanced with the capillary force of the ink, whereby a meniscus is formed. If a bubble 19 of a radius r ($\mu$m) is present in the ink, the internal pressure of the bubble 19 can be represented by:

$$\text{atmospheric pressure}-P+2\gamma/r \quad (1)$$

where $\gamma$ is the surface tension (dyn/cm) of the ink. In this state the bubble 19 is brought closer to the end A and is made to communicate with the external air at a certain point. In case (cf. FIG. 11B):

$$\text{atmospheric pressure}-P+2\gamma/r>\text{atmospheric pressure} \quad (2)$$

or $$P<2\gamma/r \quad (3)$$

the bubble 19 is discharged into the external air just as if a balloon shrinks since the internal pressure thereof is higher than the atmospheric pressure, whereby a meniscus is formed as indicated by a broken line. On the other hand, in case (cf. FIG. 11C):

$$\text{atmospheric pressure}-P+2\gamma/r<\text{atmospheric pressure} \quad (4)$$

or $$P>2\gamma/r \quad (5)$$

the air flows rapidly from the exterior into the bubble 19 because the internal pressure of the bubble 9 is lower than the atmospheric pressure, whereby the interior of the pipe is instantaneously filled with air as indicated by a broken line.

As will be apparent from the foregoing explanation, in case there exists a bubble of a magnitude satisfying a condition $P>2\gamma/r$ or $r>2\gamma/P$ in the vicinity of the ink path, there may result a phenomenon that the ink in the ink jet head is emptied at the moment when such retentive bubble comes into communication with the external air. According to an experiment of the present inventors conducted with ink of $\gamma$=47.8 dyn/cm and a negative pressure P=1 kPa in the ink tank, there is calculated a critical radius 95.6 $\mu$m of the retentive bubble, which approximately coincides with the anticipated value.

In order to suppress the growth of such retentive bubble to a level causing detrimental effect on the ink supply characteristics, the present inventors have found a configuration having projections on the internal surface of the orifice plate, at a position directly above the ink supply aperture. It is observed that, in the presence of such projections, the retentive bubble, which sticks to and grows on the internal surface of the orifice plate, does not grow beyond the gap between such projections. Consequently, even if such retentive bubble comes into communication with the external air, there can be prevented the worst situation where the interior of the ink jet head is emptied if the gap between the projections is smaller than $2\gamma/P$. However, the gap between the projections cannot be made smaller excessively. With an excessively small gap, the effect of the present invention cannot be obtained, and besides the retentive bubble sticking to the orifice plate enters such gap and becomes unremovable by the recovery operation such as the suction. According to the experience of the present inventors, the gap of the projections should at least be 10 $\mu$m. In the ink jet head designed for discharging ink principally composed of water, the surface tension of the ink is desirably in a range of $\gamma$=40–50 dyn/cm, and the head is preferably used with the negative pressure of the tank within a range of P=0.5–2 kPa. From these conditions, it will be understood that $a=2\gamma/P$ is generally within a range 40 $\mu m \leqq a \leqq 200$ $\mu$m. Consequently, a gap selected within a range from 10 to 40 $\mu$m functions preferably for the inks of various surface tensions and the ink tanks of various negative pressures, generally considered suitable for the ink jet head.

Further investigation has clarified that the intrusion of the bubble into the ink path can be significantly reduced by a configuration in which the ink path includes, in a portion between the ink supply aperture of the substrate and the ink discharge energy generating element, a common area communicating with the adjacent ink discharge energy generating element. More specifically, in a configuration in which the portion from the vicinity of the ink supply aperture, where the retentive bubble tends to be generated, to the electrothermal converting element is separated as an individual ink path, such retentive bubble covers the end of the ink path at the side of the ink supply aperture and is thus trapped in the ink path. In the configuration of the present invention, the ink path is provided, in the portion from the ink supply aperture of the substrate to the ink discharge energy generating element, with a common area communicating with the adjacent ink discharge energy generating element. Consequently the ink supply to individual ink discharge energy generating element in each ink path can be made at least through two paths on the substrate, so that, even if a part of the ink supply paths is covered by the retentive bubbles, the ink can be supplied through the remaining ink supply path and the possibility of intrusion of the retentive bubble into the ink path can therefore be significantly reduced.

FIGS. 12A to 12C are schematic views showing a representative ink jet head with the configuration of the present invention, in which the orifice plate is provided with plural projections in a position corresponding to the ink supply aperture and the ink path is provided, in the portion between the ink supply aperture of the substrate and the ink discharge energy generating element, with the common area communicating with the adjacent ink discharge energy generating element.

Figure 4A:
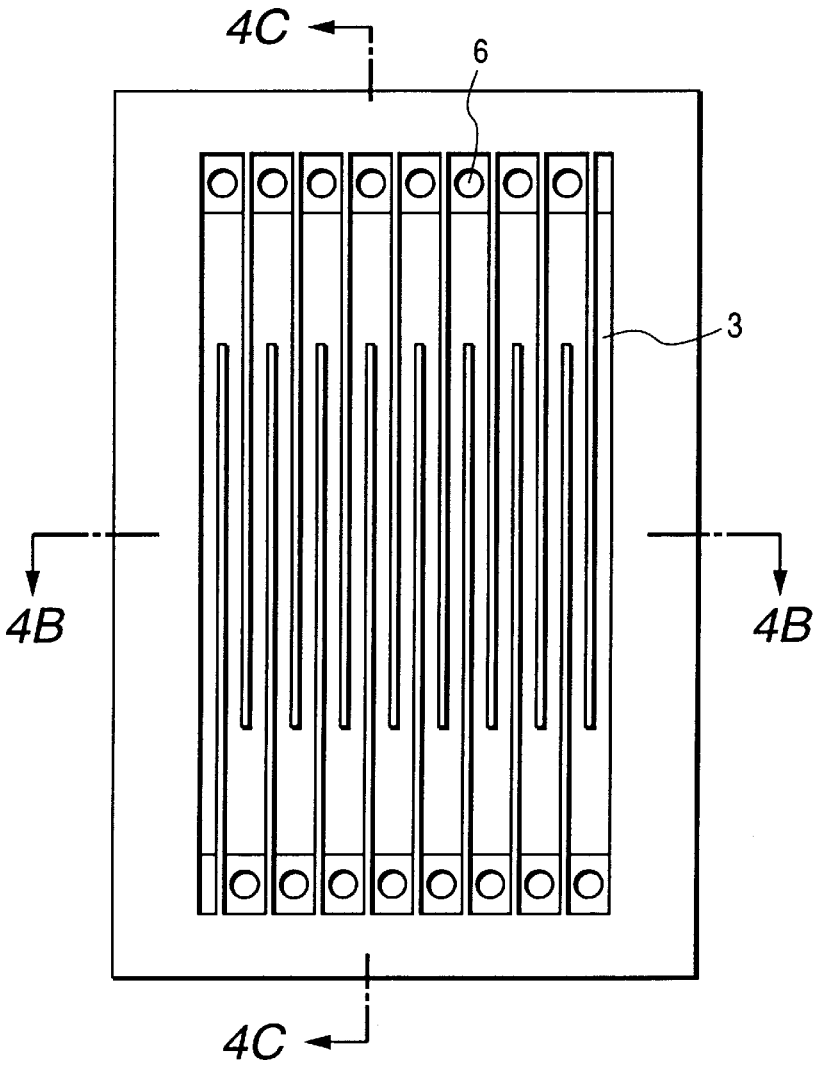
Figure 4C:
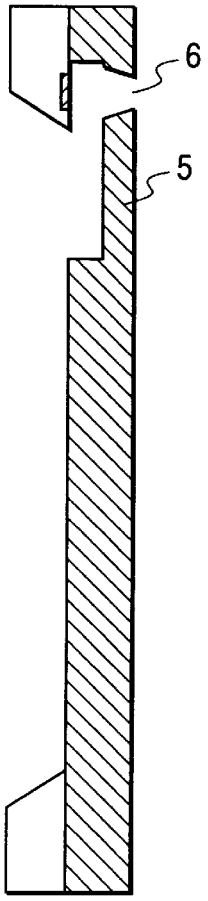
FIGS. 4B and 4C are schematic cross-sectional views thereof.
Figure 4B:
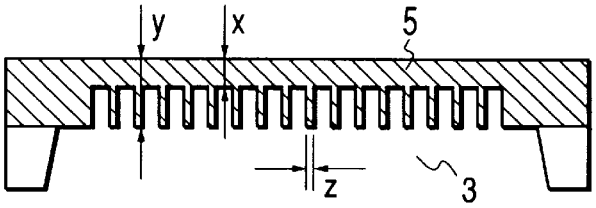

In the representative ink jet head of the configuration of the present invention, it is confirmed that the bubble may grow in two positions, namely the bubble sticking to and growing on the internal surface of the orifice plate and the bubble sticking to and growing on the end portion of the projection. The former retentive bubble, which sticks to and grows on the internal surface of the orifice plate, can be suppressed by the projections as explained in the foregoing, whereby stable ink supply can be realized. On the other hand, the latter retentive bubble, which sticks to and grows on the end portion of the projection, is observed to grow as shown in FIGS. 4A to 4C. Such retentive bubble is also locally deformed slightly by the ink flow toward the ink discharge opening, for refilling the ink path after the ink droplet discharge, but the detrimental phenomenon as in the conventional configuration is not observed. This is because the projections provided on the internal surface of the orifice plate are so constructed as to prevent the intrusion of the retentive bubble into the ink paths, and also because the ink path is provided, in the portion between the ink supply aperture of the substrate and the ink discharge energy generating element, with the common area communicating with the adjacent ink discharge energy generating element to enable ink supply from a wide area as indicated by arrows, whereby the ink supply does not easily become deficient. Stated differently, in the configuration of the present invention, the ink in the ink path is not interrupted by the retentive bubble intruding in the ink path, whereby the deficiency of ink supply to the ink path and the emptying of the interior of the ink jet head by the communication of the bubble with the external air can mostly be prevented. In this manner there can be provided an ink jet head of high reliability, capable of stable ink droplet discharge.

In the following there will be explained examples of the present invention.

EXAMPLE 1

In the present example 1, an ink jet head was prepared according to the procedure shown in FIGS. 2A to 2G. The orifice plate was provided, in a portion above the ink supply aperture, with a rib structure as shown in FIGS. 4A, 4B and 4C, wherein FIGS. 4B and 4C are cross-sectional views respectively along lines 4B—4B and 4C—4C in FIG. 4A. The thickness of the orifice plate was so selected that x=8 $\mu$m and y=20 $\mu$m in FIG. 4B (thickness of rib being y−x=12 $\mu$m), while the width of the rib was selected as z=15 $\mu$m.

Figure 3A:
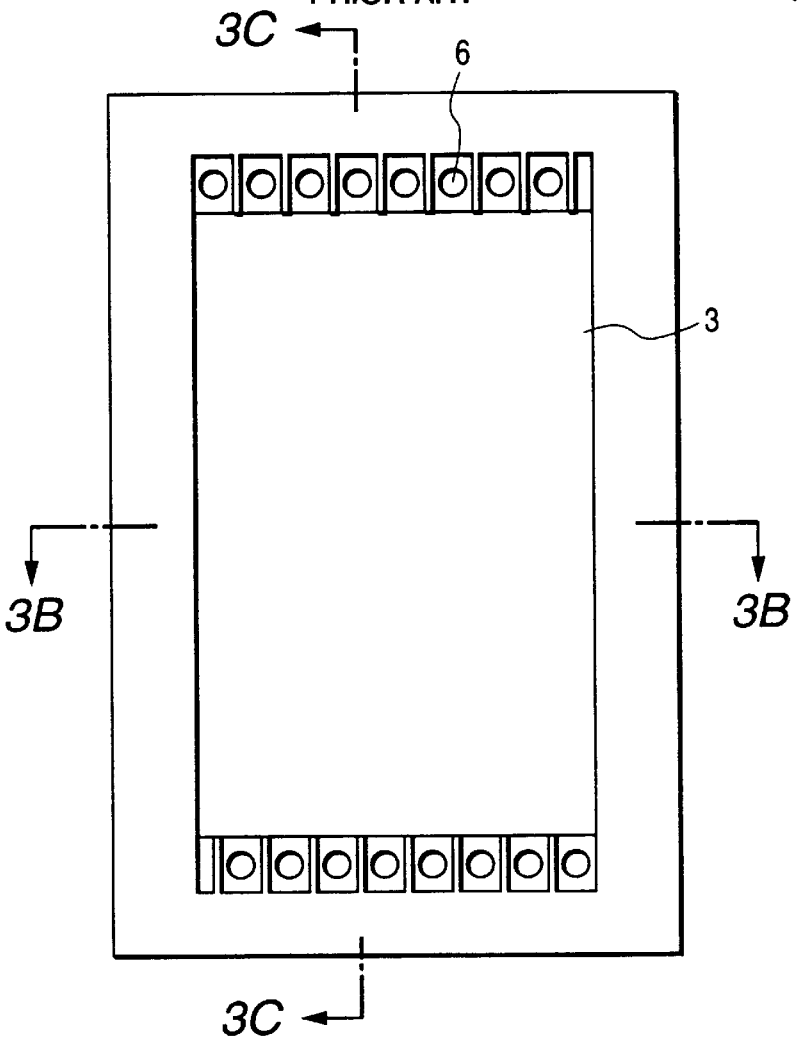
FIG. 3A PRIOR ART
Figure 3C:
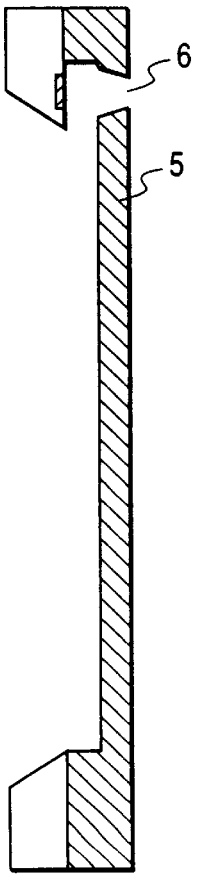
FIG. 3C PRIOR ART
FIGS. 3B and 3C are schematic cross-sectional views thereof.
Figure 3B:
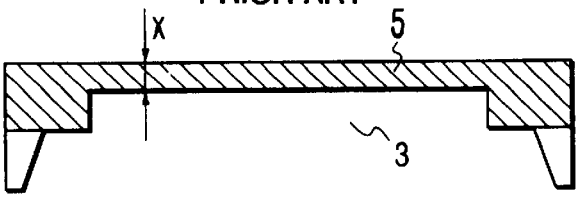
FIG. 3B PRIOR ART

As a conventional example, the thickness of the orifice plate of the ink jet head shown in FIGS. 3A to 3C is x=8 $\mu$m as shown in FIG. 3A.

The following alternative experiment was conducted in order to measure the mechanical strength of the orifice plates in these ink jet heads.

Figure 7:
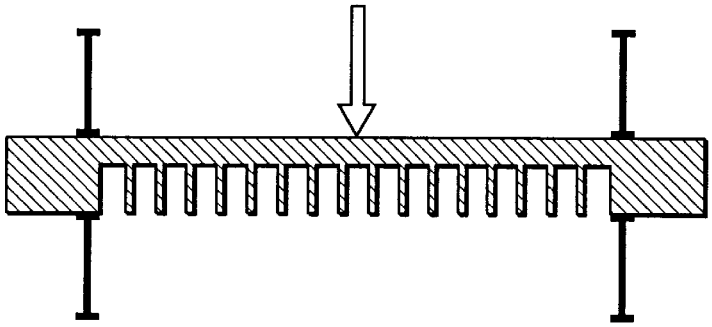
FIG. 7 is a schematic view showing the configuration of an alternative experiments of embodiments 1 to 4 of the present invention.

The orifice plate alone of the ink jet head shown in FIGS. 4A to 4C was prepared and was supported at both ends as shown in FIG. 7. Then the center of such orifice plate model was pushed with a push-pull gauge from the side of the orifice face (side without the ribs) as indicated by an arrow in FIG. 7, and the maximum stress at the breakage of the orifice plate was measured.

In the above-explained alternative experiment, the orifice plate model of the present example 1 showed a maximum stress of $7.5\times10^{10}$ Pa, while the orifice plate model of the conventional ink jet head shown in FIGS. 3A to 3C, prepared and measured under the same conditions, showed a maximum stress of $2.6\times10^{10}$ Pa.

These results indicate that the rib structure as shown in FIGS. 4A to 4C elevates the mechanical strength of the orifice plate of the ink jet head to about 3 times of that of the conventional configuration. Also the ink jet head of the present example 1 provided printing of very high quality at a discharge frequency of f=15 kHz, employing an ink liquid consisting of pure water/diethylene glycol/isopropyl alcohol/lithium acetate/black dye Food Black 2=79.4/15/3/0.1/2.5.

Also the orifice plate showed slight swelling after a preservation test for 3 months in the ink at 60° C., simulating the use of the ink jet head of the example 1 for a prolonged period. However the ink jet head in such state provided satisfactory recording with a discharge frequency of f=15 kHz, without any detrimental effect on the discharge characteristics.

EXAMPLE 2

Also in this example 2, an ink jet head was prepared in the same manner as in the example 1.

Figure 5A:
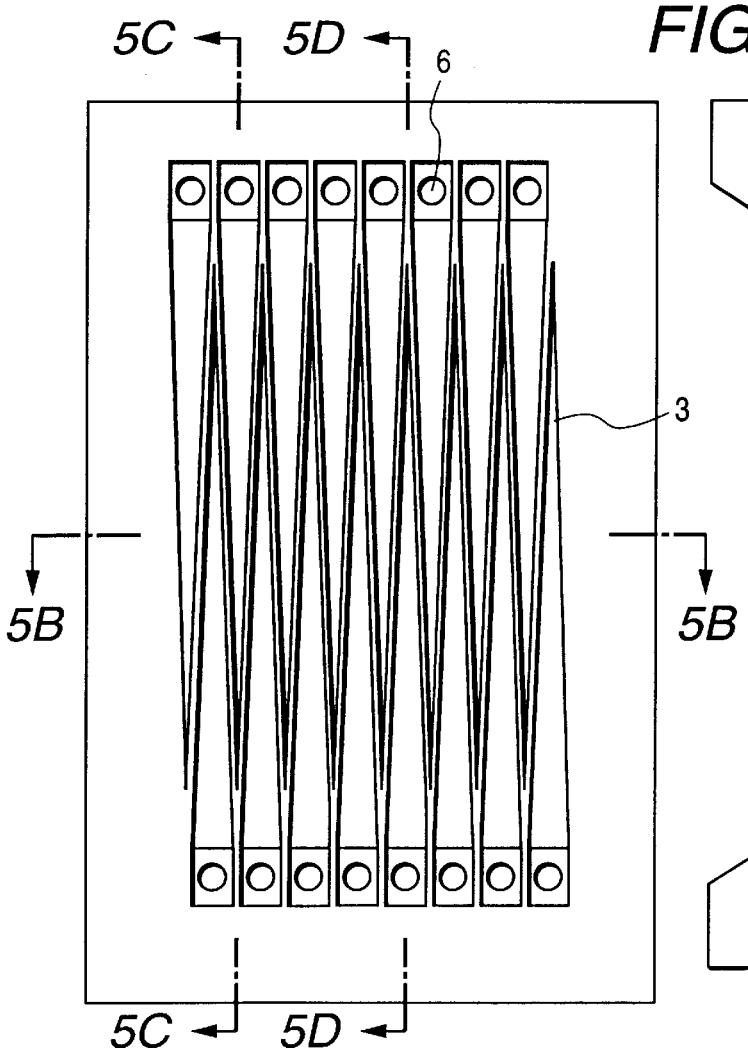
Figure 5C:
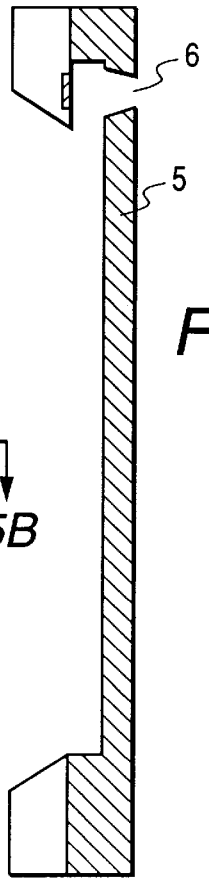
FIGS. 5B, 5C and 5D are schematic cross-sectional views thereof.
Figure 5D:
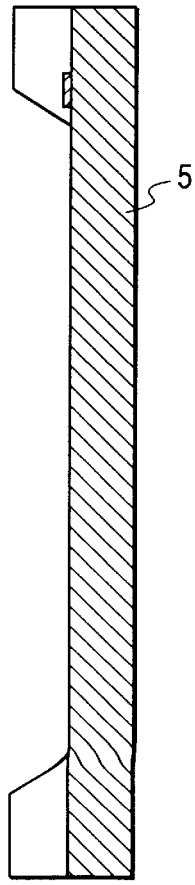
Figure 5B:
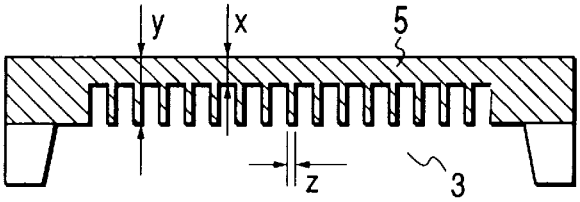

The orifice plate was provided, in a portion above the ink supply aperture, with a rib structure as shown in FIGS. 5A, 5B, 5C and 5D, wherein FIGS. 5B, 5C and 5D are cross-sectional views respectively along lines 5B—5B, 5C—5C and 5D—5D in FIG. 5A. The thickness of the orifice plate was so selected that x=8 μm and y=20 μm in FIG. 5B (thickness of rib being y−x=12 μm), while the width of the rib was selected as z=15 μm.

Also in this example, an orifice plate model was prepared and was subjected to the measurement of the maximum stress, which proved to be $1.4\times10^{11}$ Pa. This result indicates that the rib structure as shown in FIGS. 5A to 5D elevates the mechanical strength of the ink jet head to about 5 times of that of the conventional configuration.

Also the ink jet head of the present example 2 provided printing of very high quality at a discharge frequency of f=15 kHz, employing an ink liquid consisting of pure water/diethylene glycol/isopropyl alcohol/lithium acetate/black dye Food Black 2=79.4/15/3/0.1/2.5.

Also the orifice plate did not show any swelling after a preservation test for 3 months in the ink at 60° C., simulating the use of the ink jet head of the example 2 over a prolonged period. Also the ink jet head in such state provided satisfactory recording at a discharge frequency of f=15 kHz.

EXAMPLE 3

Also in this example 3, an ink jet head was prepared in the same manner as in the example 1.

Figure 6A:
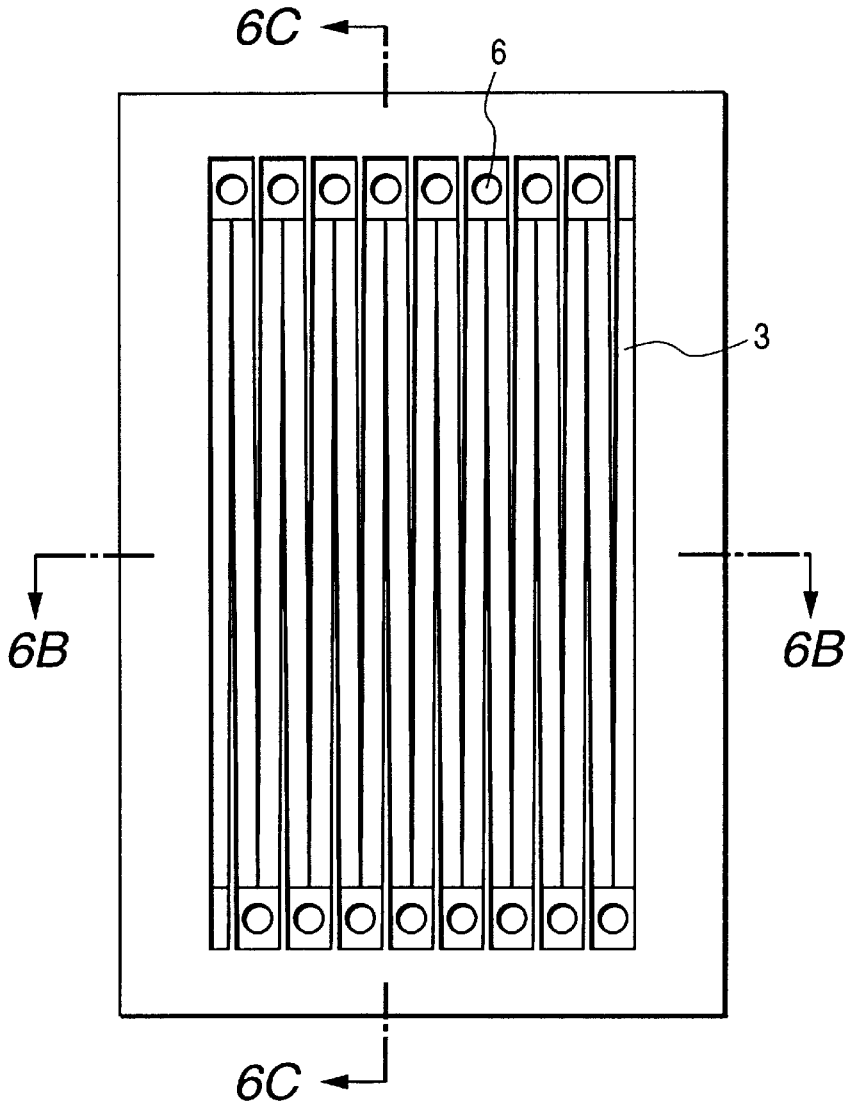
Figure 6C:
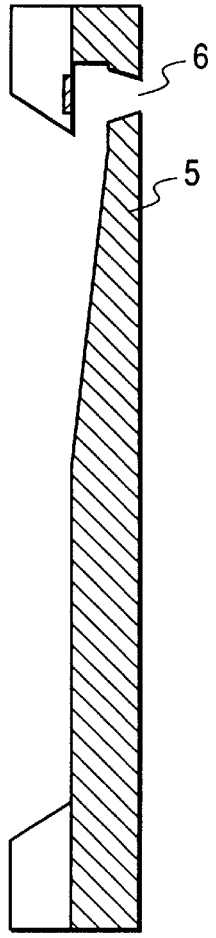
FIGS. 6B and 6C are schematic cross-sectional views thereof.
Figure 6B:
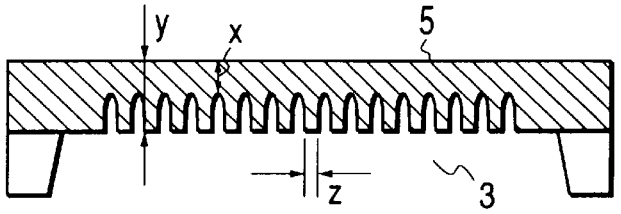

The orifice plate was provided, in a portion above the ink supply aperture, with a rib structure as shown in FIGS. 6A, 6B and 6C, wherein FIGS. 6B and 6C are cross-sectional views respectively along lines 6B—6B and 6C—6C in FIG. 6A.

As shown in these drawings, the rib structure of the present example had a rounded shape in the 6B—6B cross section and an inclined structure in the 6C—6C cross section. The thickness of the orifice plate was so selected that x=8 μm and y=20 μm in FIG. 6B (thickness of rib being y−x=12 μm), while the width of the rib was selected as z=20 μm.

Also in this example 3, an orifice plate model was prepared and was subjected to the measurement of the maximum stress, which proved to be $1.0\times10^{11}$ Pa. This result indicates that the rib structure as shown in FIGS. 6A to 6C elevates the mechanical strength of the ink jet head to about 4 times of that of the conventional configuration.

Also the ink jet head of the present example 3 provided printing of very high quality at a discharge frequency of f=20 kHz, employing an ink liquid consisting of pure water/diethylene glycol/isopropyl alcohol/lithium acetate/black dye Food Black 2=79.4/15/3/0.1/2.5. This result indicates that the aforementioned rounded and inclined structures significantly improves the release of the bubble in thus structured portions.

Also the orifice plate did not show any swelling after a preservation test for 3 months in the ink at 60° C., simulating the use of the ink jet head of the example 3 over a prolonged period. Also the ink jet head in such state provided satisfactory recording at a discharge frequency of f=20 kHz.

EXAMPLE 4

Also in this example 4, an ink jet head was prepared in the same manner as in the example 1.

Figure 8A:
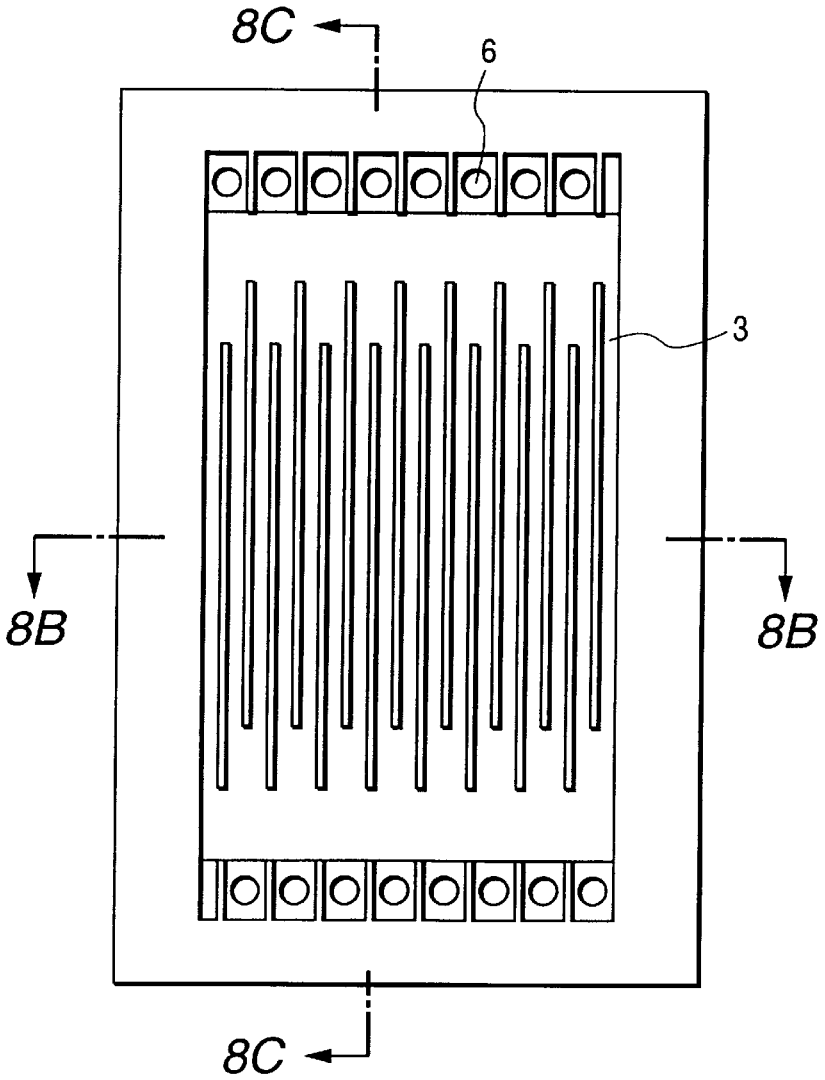
Figure 8C:
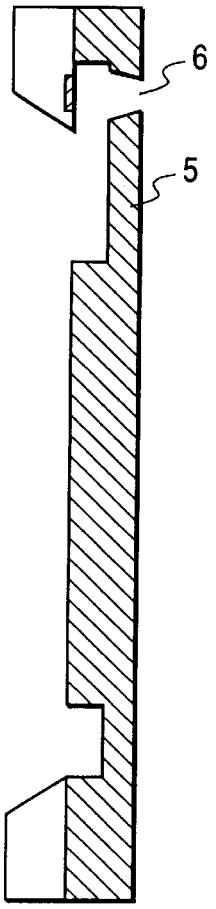
FIGS. 8B and 8C are schematic cross-sectional views thereof.
Figure 8B:
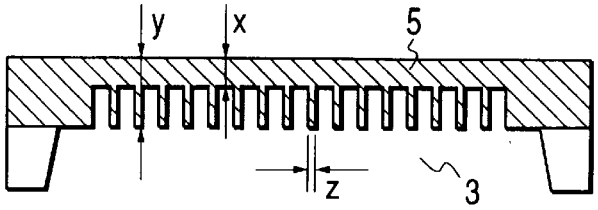

The orifice plate was provided, in a portion above the ink supply aperture, with a rib structure as shown in FIGS. 8A, 8B and 8C, wherein FIGS. 8B and 8C are cross-sectional views respectively along lines 8B—8B, and 8C—8C in FIG. 8A. The thickness of the orifice plate was so selected that x=8 μm and y=20 μm in FIG. 8B (thickness of rib being y−x=12 μm), while the width of the rib was selected as z=15 μm.

Also in this example, an orifice plate model was prepared and was subjected the measurement of the maximum stress, which proved to be $6.5\times10^{10}$ Pa. This result indicates that the rib structure as shown in FIGS. 8A to 8C elevates the mechanical strength of the ink jet head to about 2.5 times of that of the conventional configuration.

Also the ink jet head of the present example 4 provided printing of very high quality at a discharge frequency of f=15 kHz, employing an ink liquid consisting of pure water/diethylene glycol/isopropyl alcohol/lithium acetate/black dye Food Black 2=79.4/15/3/0.1/2.5.

Also the orifice plate did not show any swelling after a preservation test for 3 months in the ink at 60° C., simulating the use of the ink jet head of the example 4 over a prolonged period. Also the ink jet head in such state showed satisfactory ink discharge in a recording operation at a discharge frequency of f=15 kHz.

In the following there will be explained, by examples 5 to 8, an embodiment particularly designed in consideration of the influence of the retentive bubbles.

Figure 9:
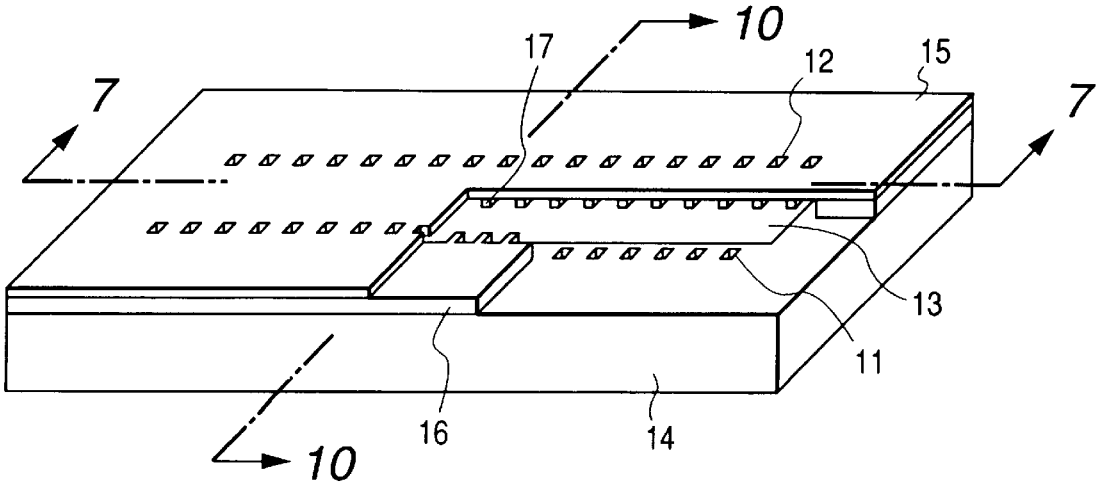
FIG. 9 is a schematic view of an ink jet head, representing a basic configuration of the present invention.

FIG. 9 is a schematic view of an ink jet head, representing a basic embodiment of the present invention and cut along a suitable plane for the ease of explanation. In this and ensuing drawings, the electric wirings for driving the electrothermal converting elements are omitted. Also FIGS. 10A to 10G are cross-sectional views, along a line 10—10, of an ink jet substrate shown in FIG. 9, schematically showing the steps of preparation of the ink jet head of the present embodiment.

Referring to FIG. 9, a substrate 14 is provided with discharge energy generating elements 11 and an ink supply aperture 13, which consists of an oblong groove-shaped penetrating aperture. On each side of the longitudinal direction of the ink supply aperture 13, there is provided an array of electrothermal converting elements 11, serving as the ink discharge energy generating elements, wherein such elements are arranged with a pitch of 300 dpi in each array and in mutually staggered manner in the both arrays. On the substrate 14, there is provided a cover resin layer 16 for constituting the ink path walls defining the ink paths, and, on the cover resin layer 16, there is provided an orifice plate 15 provided with discharge openings 12. In FIG. 9, the cover resin layer 16 and the orifice plate 15 are illustrated as separate members, but it is also possible to simultaneously form the cover resin layer 16 and the orifice plate 15 as an integral member, by applying the cover resin layer 16 for example by spin coating on the substrate 14. On the internal surface of the orifice plate, in a position directly above the ink supply aperture 13, there are provided projections 17 for alleviating the detrimental effect of the bubbles, remaining in the ink jet head, on the ink discharge as explained in the foregoing. Also in the ink jet head of the present invention, each ink path is provided, in a portion between the ink supply aperture of the substrate and the ink discharge energy generating element, with a common area communicating with the adjacent discharge energy generating element. More specifically, the partition walls for defining the individual ink path corresponding to each electrothermal converting element are not extended to the ink supply aperture. The above-mentioned projection is preferably composed of a rib member along the direction of ink flow from the ink supply aperture 13 to the discharge opening 12, in order to minimize the flow resistance in the ink path, but it may also be composed, for example, of plural pillars as long as the aforementioned condition for the gap is satisfied. Such projection is desirably separated from the substrate in consideration of the ease of ink supply, and such separation of the projection is desirably such that the minimum distance from the end of the projection to the substrate is within a range of 10–40 μm as in the case of aforementioned gap. Also in case the projection 17 is composed of the above-mentioned rib member along the direction of the ink flow, such rib may be contacted with the substrate to increase the strength of the orifice plate. Furthermore, in such case, the end portion of the rib may be tapered to reduce the flow resistance in the ink path. Also in FIG. 9, the projections 17 and the ink path walls 16 have a same height, but they may have different heights, as long as the minimum distance from the end of the projection to the substrate is within the above-mentioned range of 10–40 μm.

Also the above-mentioned partition walls are desirably so-constructed that the minimum distance from the end portion thereof to the substrate is within a range of 10–40 μm, as in the case of the projections.

In the following there will be explained an example of the producing method for the ink jet head of the present invention.

Figure 10A:
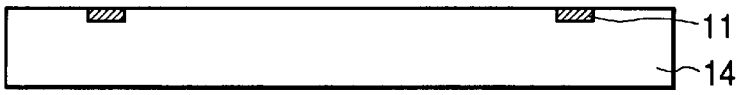
FIGS. 10A, 10B, 10C, 10D, 10E, 10F and 10G are schematic views showing the method of the present invention for producing the ink jet head.
Figure 10B:
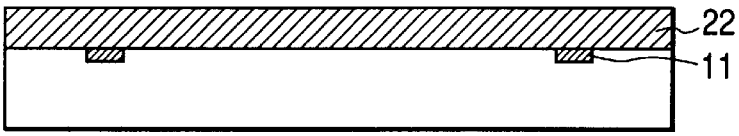
Figure 10C:
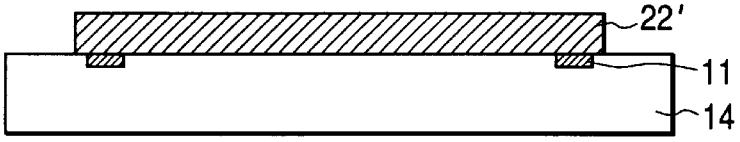
Figure 10D:
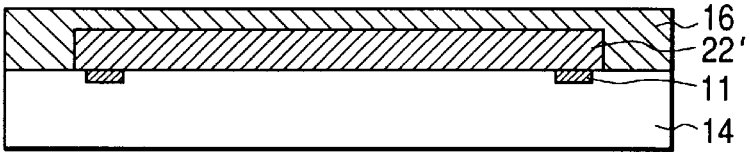
Figure 10E:
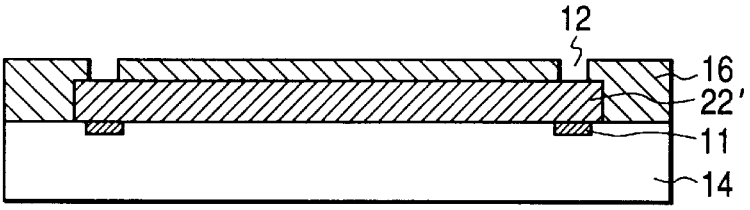
Figure 10F:
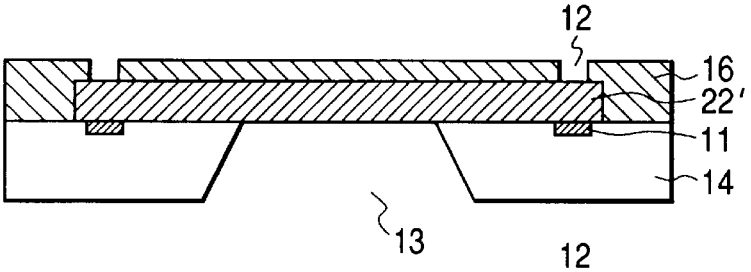
Figure 10G:
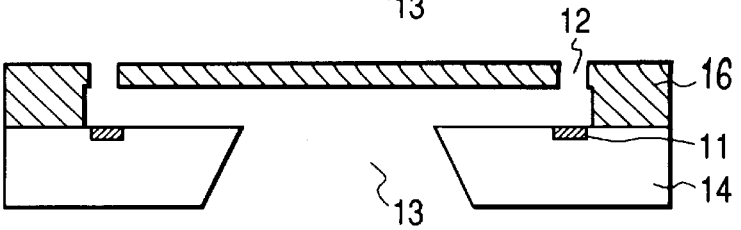

At first there is provided a substrate 14, bearing plural electrothermal converting elements 11 and wirings (not shown) required for driving such converting elements on a Si chip (FIG. 10A), and a soluble resin layer 22 is formed on the substrate 14 (FIG. 10B). Then the resin layer 22 is patterned, for example with a photolitographic process, to leave a pattern of the ink paths and to remove portions corresponding to the nozzle walls and the projections to be provided above the ink supply aperture according to the present invention (FIG. 10C). Then a cover resin layer 16 is formed on the soluble resin layer 22 bearing the ink path pattern (FIG. 10D), and portions of such cover resin layer 16 corresponding to the discharge openings 12 are removed (FIG. 10E). Then the ink supply aperture 13 is formed for example by chemically etching the substrate 14 from the rear side (FIG. 10F). More specifically, the supply aperture 13 is formed by anisotropic etching with a strong alkaline solution (KOH, NaOH or TMAH). Finally the soluble resin layer 22 is dissolved out (FIG. 10G) to obtain an ink jet head provided with the discharge openings 12, the ink supply aperture 13, the ink paths communicating therewith and the projections 17 formed on the orifice plate in a position directly above the ink supply aperture. The ink jet head of the present invention is completed by electrically connecting the chip with a wiring board for driving the electrothermal converting elements.

The above-explained producing method for the ink jet head is particularly suitable for the ink jet head utilizing the ink jet recording method described in the Japanese Patent Laid-Open Application Nos. 4-10940 and 4-10941. These patent applications disclose an ink droplet discharging method featured by causing a bubble, generated on the electrothermal converting element by a recording signal, to communicate with the external air, and provide an ink jet head enabling to discharge a small ink droplet (50 pl. or less). In the above-mentioned ink jet head, as the bubble comes into communication with the external air, the volume of the discharged ink droplet is principally determined by the volume of the ink present between the electrothermal converting element and the ink discharge opening. Stated differently, it is almost determined by the structure of the nozzle portion of the ink jet head. Consequently such ink jet head can provide an image of high quality, without unevenness. The configuration of the present invention is most effective in the above explained ink jet head in which the (minimum) distance between the electrothermal converting element and the discharge opening does not exceed 30 μm in order to bring the bubble into communication with the external air, but is also effectively applicable to any ink jet head of the type for discharging the ink droplet perpendicularly to the surface of the substrate bearing the electrothermal converting elements.

Also the ink jet head of the present invention can effectively relax the detrimental effect of the retentive bubble further, by driving the electrothermal converting elements in such a divided driving mode that the adjacent electrothermal converting elements are not activated at the same time.

In the following there will be explained specific examples of the structures of the ink jet head of the present invention. In the following examples, the ink jet heads were prepared according to the process shown in FIGS. 10A to 10G, with a nozzle pitch 300 dpi in each array, the orifice plate of a thickness of 8 μm, and the projections featuring the present invention and the nozzle walls of a height of 12 μm. Dye black ink (surface tension 47.8 dyn/cm, viscosity 1.8 cp, pH 9.8) made by Canon Inc. was used for evaluating the ink jet head.

EXAMPLE 5

The ink jet head of this example is illustrated in FIGS. 12A to 12C, which are respectively a magnified elevation view of the substrate bearing the electrothermal converting elements, and cross-sectional views respectively along lines 12B—12B and 12C—12C.

The projections in this example have a projected dimension of 20×150 μm onto the orifice plate, and are arranged with a pitch of 600 dpi (42.3 μm). Thus the gap between the adjacent projections is 22.3 μm at minimum.

The ink jet head of the present example was driven with a discharge frequency of 10 kHz to continuously record a solid black image, and the time of continuation of such recording was compared with a conventional ink jet head. In comparison with the conventional ink jet head, the ink jet head of this example could record the solid black image for a period about 4 times of that of the conventional head.

EXAMPLE 6

Figure 13A:
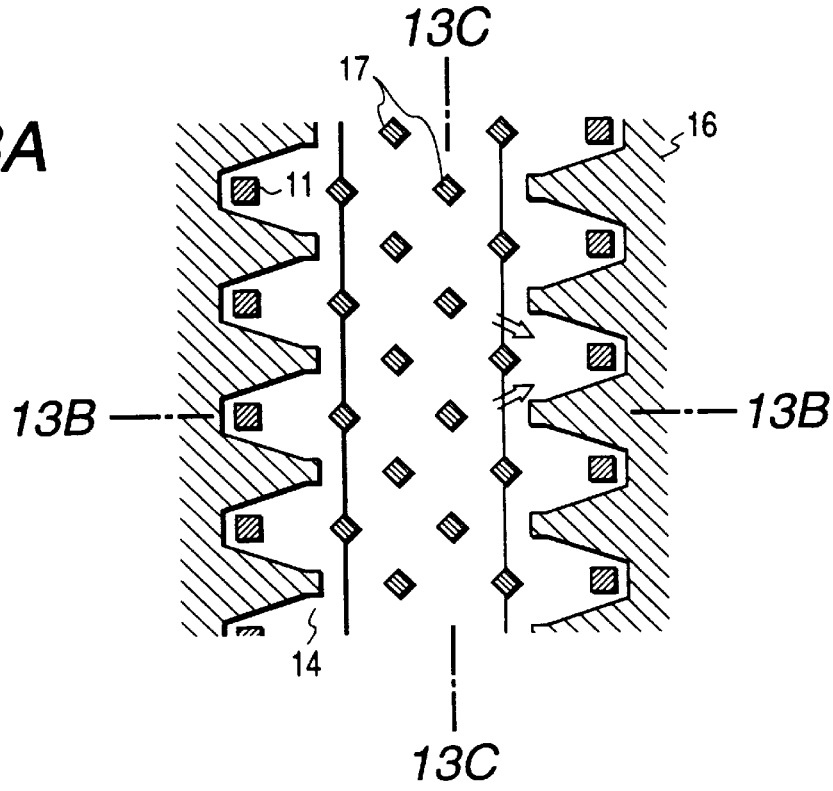
FIGS. 13A, 13B and 13C are schematic views showing an ink jet head of an embodiment 6.
Figure 13B:
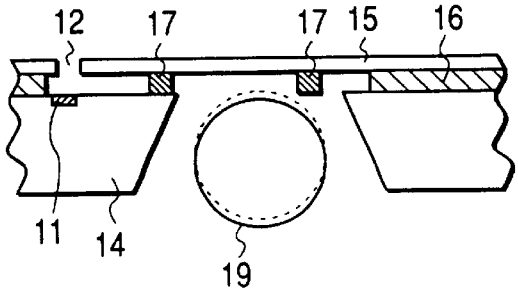
Figure 13C:
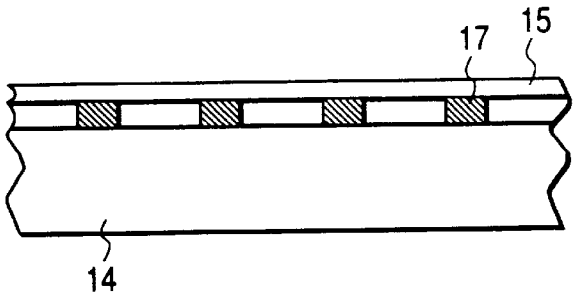

The ink jet head of this example is illustrated in FIGS. 13A to 13C, which are respectively a magnified elevation view of the substrate bearing the electrothermal converting elements, and cross-sectional views respectively along lines 13B—13B and 13C—13C.

The projections in this example have a projected dimension of 40×40 μm onto the orifice plate, and are arranged with a pitch of 80 μm (gap of 40 μm).

The ink jet head of the present example was driven with a discharge frequency of 10 kHz to continuously record a solid black image, and the time of continuation of such recording was compared with a conventional ink jet head. In comparison with the conventional ink jet head, the ink jet head of this example could record the solid black image for a period about 4 times of that of the conventional head. Thus the present invention is effective also in the above-explained configuration.

In the ink jet head provided with such orifice plate of thin film shape, the reliability of the orifice plate is apparently low in terms of the strength. Particularly in case the orifice plate is composed of a resinous material, it may be swelled and deformed by the ink, eventually causing detrimental influence on the ink droplet discharging characteristics of the ink jet head. For this reason, the following examples 7 and 8 propose to utilize the projections of the present invention also for securing the strength. More specifically, the projections are made to contact both the substrate and the orifice plate to attain a strength higher than the case in the absence of the projections on the orifice plate, thereby further improving the reliability.

EXAMPLE 7

Figure 14A:
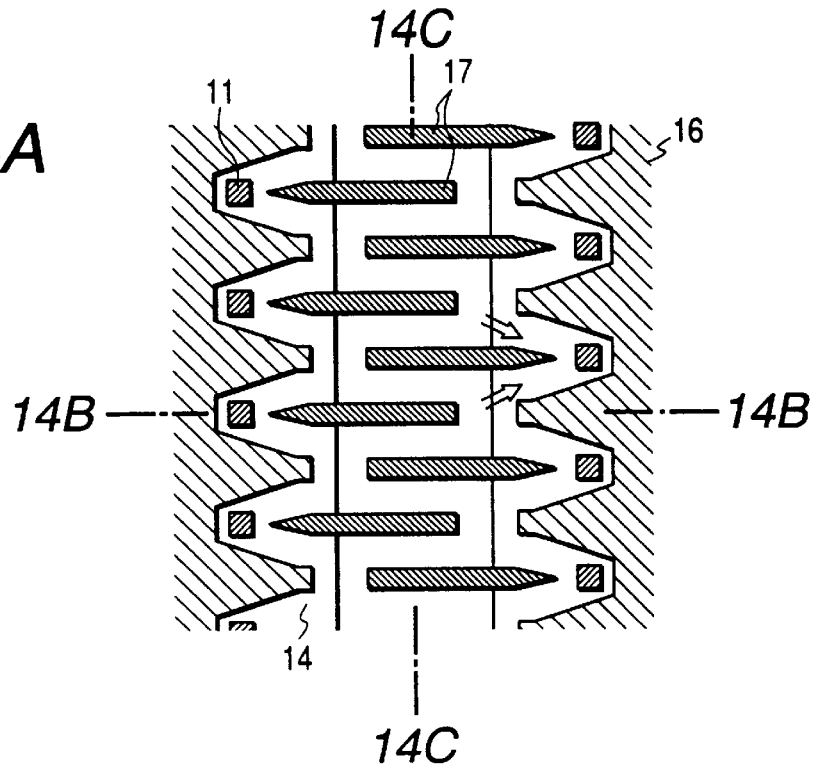
FIGS. 14A. 14B and 14C are schematic views showing an ink jet head of an embodiment 7.
Figure 14B:
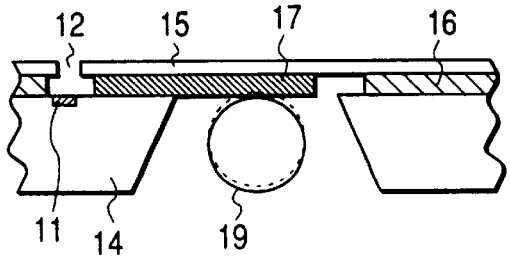
Figure 14C:
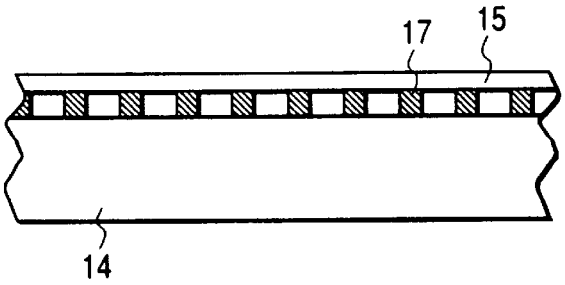

The ink jet head of this example is illustrated in FIGS. 14A to 14C, FIG. 14A is a magnified elevation view of the substrate bearing the electrothermal converting elements, and FIGS. 14B and 14C are cross-sectional views respectively along lines 14B—14B and 14C—14C.

The projections in this example are featured by a fact that they contact both the substrate and the orifice plate to improve the strength of the orifice plate and that the width of the projections in a direction parallel to the orifice plate continuously decreases toward the electrothermal converting element in order to secure the ink supply to the nozzle and to reduce the flow resistance. The width of the projections of the present example is 20 $\mu$m at the widest part and 12 $\mu$m in the narrowest part in the projection onto the orifice plate, and the projections are arranged with a pitch of 600 dpi (42.3 $\mu$m). Consequently the gap between the projections is 22.3 $\mu$m at minimum.

The ink jet head of the present example was driven with a discharge frequency of 10 kHz to continuously record a solid black image, and the time of continuation of such recording was compared with a conventional ink jet head. In comparison with the conventional ink jet head, the ink jet head of this example could record the solid black image for a period about 4 times of that of the conventional head. Thus the present invention is effective also in the above-explained configuration.

EXAMPLE 8

Figure 15A:
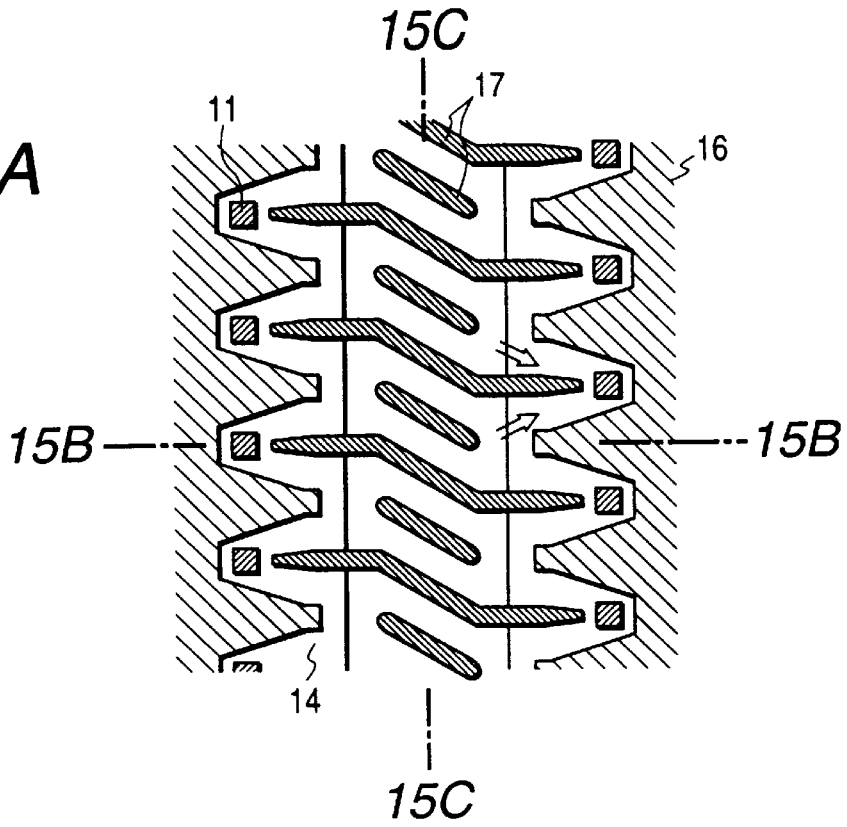
FIGS. 15A, 15B and 15C are schematic views showing an ink jet head of an embodiment 8.
Figure 15B:
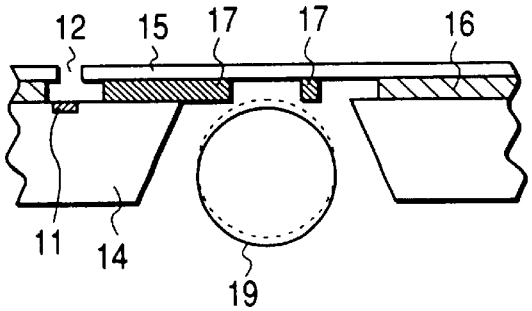
Figure 15C:
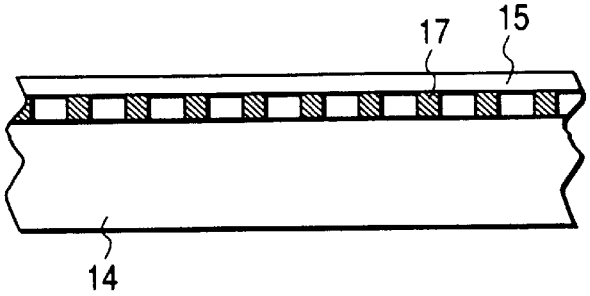

The ink jet head of this example is illustrated in FIGS. 15A to 15C, FIG. 15A is a magnified elevation view of the substrate bearing the electrothermal converting elements, and FIGS. 15B and 15C are cross-sectional views respectively along lines 15B—15B and 15C—15C.

The projections in this example are featured by a fact that a same projection contacts both the substrate and the orifice plate across the ink supply aperture, thereby improving the strength of the orifice plate and that the width of the projections in a direction parallel to the orifice plate continuously decreases toward the electrothermal converting element in order to secure the ink supply to the nozzle and to reduce the flow resistance. The width of the projections of the present example is 20 $\mu$m at the widest part and 12 $\mu$m in the narrowest part in the projection onto the orifice plate, and the projections are arranged with a pitch of 600 dpi (42.3 $\mu$m). Consequently the gap between the projections is 22.3 $\mu$m at minimum.

The ink jet head of the present example was driven with a discharge frequency of 10 kHz to continuously record a solid black image, and the time of continuation of such recording was compared with a conventional ink jet head. In comparison with the conventional ink jet head, the ink jet head of this example could record the solid black image for a period about 3 times of that of the conventional head. Thus the present invention is effective also in the above-explained configuration.

What is claimed is:

1. An ink jet head comprising:

plural discharge energy generating elements for generating energy to be used for discharging ink droplets of an ink;

ink discharge openings for discharging said ink droplets;

a substrate having thereon an array of said plural discharge energy generating elements, said array extending in a direction, and an ink supply aperture consisting of a penetrating hole extending along the direction of said array of said plural discharge energy generating elements; and an orifice plate provided with said ink discharge openings;

wherein said substrate and said orifice plate are mutually adjoined to define therebetween ink paths connecting said ink discharge openings and said ink supply aperture, wherein said orifice plate comprises plural projections each disposed in a position corresponding to said ink supply aperture, and wherein said plural projections extend, in said ink paths, from bubble generating chambers in which said plural discharge energy generating elements are provided to a position above said ink supply aperture.

2. An ink jet head according to claim 1, wherein each of said ink paths is provided, in a portion from, the ink supply aperture of said substrate to the discharge energy generating element, with a common area communicating with an adjacent one of said plural discharge energy generating elements.

3. An ink jet head according to claim 2, wherein said plural discharge energy generating elements are arranged along and on both sides of said penetrating hole.

4. An ink jet head according to claim 2, wherein a distance between one of said plural projections and an adjacent one of said plural projections is within a range from 10 $\mu$m to $2\gamma/P$ $\mu$m, wherein P (kPa) is a negative pressure by which an ink tank of the ink jet head sucks the droplets through said ink supply aperture and $\gamma$ (dyn/cm) is the surface tension of the ink.

5. An ink jet head according to claim 2, wherein a distance between one of said plural projections and an adjacent one of said plural projections is within a range from 10 $\mu$m to 40 $\mu$m.

6. An ink jet head according to claim 2, wherein a part of at least one said plural projection is in contact with said substrate.

7. An ink jet head according to claim 1, wherein said plural projections are plural ribs provided in a direction along an ink flow from said ink supply aperture to the ink discharge openings.

8. An ink jet head according to claim 7, wherein an end of at least one of said plural ribs is separated from the substrate.

9. An ink jet head according to claim 8, wherein a minimum distance between the end, separated from said substrate, of at least one of said plural ribs and the substrate is within a range from 10 $\mu$m to 40 $\mu$m.

10. An ink jet head according to claim 7, wherein an end portion of at least one of said plural ribs is tapered.

11. An ink jet head according to claim 1, wherein said discharge energy generating elements are electrothermal converting elements.

12. An ink jet head according to claim 11, wherein said electrothermal converting elements are driven in a divided manner.

13. An ink jet head according to claim 1, wherein said plural ribs are provided in one of a continuous manner and a discontinuous manner on said orifice plate, at the side of the ink paths thereof.

14. An ink jet head according to claim 1, wherein said plural ribs are mutually parallel along an extending direction and have a rectangular cross section in a direction perpendicular to said extending direction.

15. An ink jet head according to claim 1, wherein said plural ribs are mutually parallel along an extending direction and have a rounded cross section in a direction perpendicular to said extending direction.

16. An ink jet printing device comprising:

an ink jet head according to any of claims 1 to 15; and recovery means for effecting a recovery operation for said ink jet head.

* * * * *

UNITED STATES PATENT AND TRADEMARK OFFICE

CERTIFICATE OF CORRECTION

PATENT NO. : 6,137,510

DATED : October 24, 2000

INVENTOR(S) : TAMAKI SATO ET AL.

It is certified that error appears in the above-identified patent and that said Letters Patent is hereby corrected as shown below:

ON THE COVER PAGE [56] References Cited

"0 244 937 6/1987 European Pat. Off." should read --0224 937 6/1987 European Pat. Off.--;

COLUMN 1

Line 16, "socalled" should read --so-called--;

COLUMN 2

Line 18, "1μs" should read --1μm--;

COLUMN 6

Line 50, "bubble 9" should read --bubble 19--.

Signed and Sealed this

Eighth Day of May, 2001

*Attest:*

Nicholas P. Godici

NICHOLAS P. GODICI

*Attesting Officer*

*Acting Director of the United States Patent and Trademark Office*